US006246165B1

(12) United States Patent
Beeteson

(10) Patent No.: US 6,246,165 B1
(45) **Date of Patent: *Jun. 12, 2001**

(54) MAGNETIC CHANNEL CATHODE

(75) Inventor: John Stuart Beeteson, Skelmorlie (GB)

(73) Assignee: International Business Machines Corporation, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/198,201

(22) Filed: Nov. 23, 1998

(30) Foreign Application Priority Data

Sep. 3, 1998 (GB) ..... 9819234

(51) Int. Cl.[7] ..... H01J 29/70
(52) U.S. Cl. ..... 313/422; 313/431
(58) Field of Search ..... 313/422, 495, 313/431, 337; 345/13; 445/23

(56) References Cited

U.S. PATENT DOCUMENTS 5,227,691 7/1993 Murai et al. .
5,844,354 * 12/1998 De Zwart et al. ..... 313/422
5,857,883 * 1/1999 Knickerbocker et al. ..... 445/23
5,959,397 * 9/1999 Lambert et al. ..... 313/422

FOREIGN PATENT DOCUMENTS 0 213 839 3/1987 (EP) ..... H01J/31/12
0399515 5/1990 (EP) ..... H01J/31/12
0522544 7/1992 (EP) ..... H01J/31/12
2304981 8/1995 (GB) ..... H01J/3/02
2322001 2/1997 (GB) ..... H01J/3/03

* cited by examiner

*Primary Examiner*—Nimeshkumar D. Patel
*Assistant Examiner*—Karrabi Guharay
(74) *Attorney, Agent, or Firm*—Robert P. Tassinari, Jr.

(57) ABSTRACT

An electron source comprises a permanent magnet having channels within the plate extending between opposite poles of the magnet. The internal surfaces of the channels are conductive. A cathode means is located at a first pole of the magnet, at one end of the channels. Each channel within the magnet has a plurality of perforations located on a surface of the permanent magnet, the surface extending between opposite poles of the magnet. A potential applied between the cathode and the conductive internal surfaces of the channels causes electrons to be received into the channels and each perforation forms electrons received from the cathode means into an electron beam for guidance towards a target.

20 Claims, 4 Drawing Sheets

MAGNETIC CHANNEL CATHODE

TECHNICAL FIELD OF THE INVENTION

The present invention relates to an area cathode suitable for use in a flat panel display and more particularly to an area cathode in which electrons are confined in magnetic channels and extracted by low voltage electrostatic fields.

BACKGROUND OF THE INVENTION

An area cathode of the present invention is particularly although not exclusively useful in display applications, especially flat panel display applications. Such applications include television receivers and visual display units for computers, especially although not exclusively portable computers, personal organisers, communications equipment, and the like.

All flat panel CRT technologies require an area cathode, that is a uniform planar source of electrons the same area as the display. There have been many designs developed over the years, based on technologies such as Field Emission Devices (FEDs), Metal-Insulator-Metal devices (MIMs) and the like. Probably the most successful types have been the virtual thermionic cathode from Source Technology, disclosed in European Patent Application 0 213 839, and the secondary emission channel hopping cathode developed by Philips for their Zeus display. All current designs, however, suffer from significant disadvantages of one sort or another. In particular the virtual thermionic type has high power and hence a major heat dissipation problem, and the channel hopping type has high and non uniform channel extraction voltages.

U.S. Pat. No. 5,227,691 discloses a flat tube display apparatus in which a row of many electron beam generators is arranged transversely in a thin flat vacuum tube body to generate a number of beams in parallel with each other which travel in parallel with an image screen and in which the electron beam generators are arranged to deflect the beams toward the image screen at a predetermined position. The beams are guided without being widely diverged due to the provision of a number of side walls arranged in parallel with each other to confine the beams and due to the provision of alternately strong and weak magnetic fields along the side walls forming periodic magnetic lenses. The electron beams are deflected electrostatically or using a magnetic field towards an electron beam multiplier and a phosphor screen.

It would be desirable to produce an area cathode that has:

1. An electron source based on known materials;
2. Generation of electrons at a low eV (hence low extraction voltages);
3. A narrow eV spread (hence low beam spreading);
4. A high degree of uniformity;
5. Low power and heat;
6. Isolation from external electric and magnetic fields;
7. Protection of the electron source from ion bombardment; and
8. Mechanical simplicity leading to low cost.

SUMMARY OF THE INVENTION

Accordingly, the invention provides an electron source comprising cathode means, a permanent magnet having a plurality of channels, extending between opposite poles of the magnet, parallel to a first surface of the magnet, the cathode means being located at a first pole of the magnet, the internal surfaces of each of the channels being conductive, each channel having a plurality of perforations located on the first surface of the permanent magnet, the surface extending between opposite poles of the magnet, wherein a potential applied between the cathode means and the conductive internal surfaces of the channels causes electrons to be received into the channels and wherein each perforation forms electrons received from the cathode means into an electron beam for guidance towards a target.

In a first embodiment, the cathode means comprises a line filament cathode. The use of a line filament cathode has the effect of providing a point thermionic cathode in each of the channels.

Preferably, the line filament cathode is indirectly heated. Use of an indirectly heated cathode means that the outer conductive sheath of the cathode can be held at a uniform 0 V, isolated from the internal heated core. This has the advantage that there is no variation in voltage along the length of the cathode and hence no change in eV of the emitted electrons.

In a second embodiment, the cathode means comprises a micromachined cathode. These cathodes have the advantage of a very low power and a low heat load.

Preferably, the permanent magnet comprises a first magnetic plate having grooves, extending between opposite poles of the magnet, along a first surface of the first magnetic plate, and a second magnetic plate having a plurality of perforations, said second plate being located so as to close the grooves to form channels, the channels having perforations located on a surface extending between opposite poles of the magnet. This allows the magnet to be constructed using standard mass production processes to form the grooved plate.

Preferably, the channels are arranged at a pitch corresponding to the pixel pitch of a display incorporating the electron source. This provides a single source of electrons for each of the pixels of the display incorporating the electron source.

Preferably, the magnet plane furthest from the perforations is at least twice as thick as the channel depth. This has the advantage that the flux density is increased within the channel, so increasing the isolation from external fields. This also has the advantage that null field points and non-linearities present in the channel are moved into the perforations. This provides an essentially linear field in the channels, with no field reversals.

Preferably, each channel has a depth greater than the width of the channel and wherein the portion of the channel furthest from the perforations is curved in cross-section. This has the advantage of increasing the volume of magnetic material on the non-perforated side of the magnet plate.

In a variation of the preferred embodiment, each channel is quadrilateral in cross-section, being either rectangular in cross-section or square in cross-section. This has the advantage of making the manufacture of a magnet plate having grooves particularly suited to conventional mass production techniques.

Preferably, the perforations are disposed in the magnet in a two dimensional array of rows and columns.

In a preferred embodiment, the perforations are arranged at a pitch corresponding to the pixel pitch of a display incorporating the electron source. This provides a single source of electrons for each of the pixels of the display incorporating the electron source.

Preferably, each of said channels is unperforated for a distance from the cathode means of ten or more times the pitch of the perforations. This unperforated distance means that the magnetic field is linear over a sufficiently long distance so as to allow collimation of the electrons to become established.

Preferably, the electron source further comprises a non-magnetic stainless steel plate located on the surface of the magnet furthest from the perforations. The use of a stainless steel plate gives the magnet assembly increased tensile strength.

In a variation of the preferred embodiment, the conducting surfaces associated with each of the channels are electrically separated. Since the current that enters each of the channels is all absorbed by the channel walls during the display blanking periods, by arranging for separate connection of each channel conducting surface, emission control on a channel by channel basis may be provided.

The invention also provides a display device comprising: an electron source as described above; a screen for receiving electrons from the electron source, the screen having a phosphor coating facing the side of the magnet having perforations; two perforated ceramic plates, each having a conductive surface, so as to cause a flow of electrons from the cathode to the phosphor coating via the channels and perforations thereby to produce an image on the screen.

BRIEF DESCRIPTION OF THE DRAWINGS

A preferred embodiment of the present invention will now be described, by way of example only, with reference to the accompanying drawings in which.

DETAILED DESCRIPTION OF THE INVENTION

The present invention will now be described with reference to an embodiment of the invention. The embodiment uses a line filament cathode (or multiple small emitters).

The present invention is based on electron confinement in magnetic channels, with electron extraction by low electrostatic fields. The electron source can be any type, but the preferred embodiment is a low power thermionic filament type, which has the advantage that the technology is well understood.

Basic Construction

Figure 1:
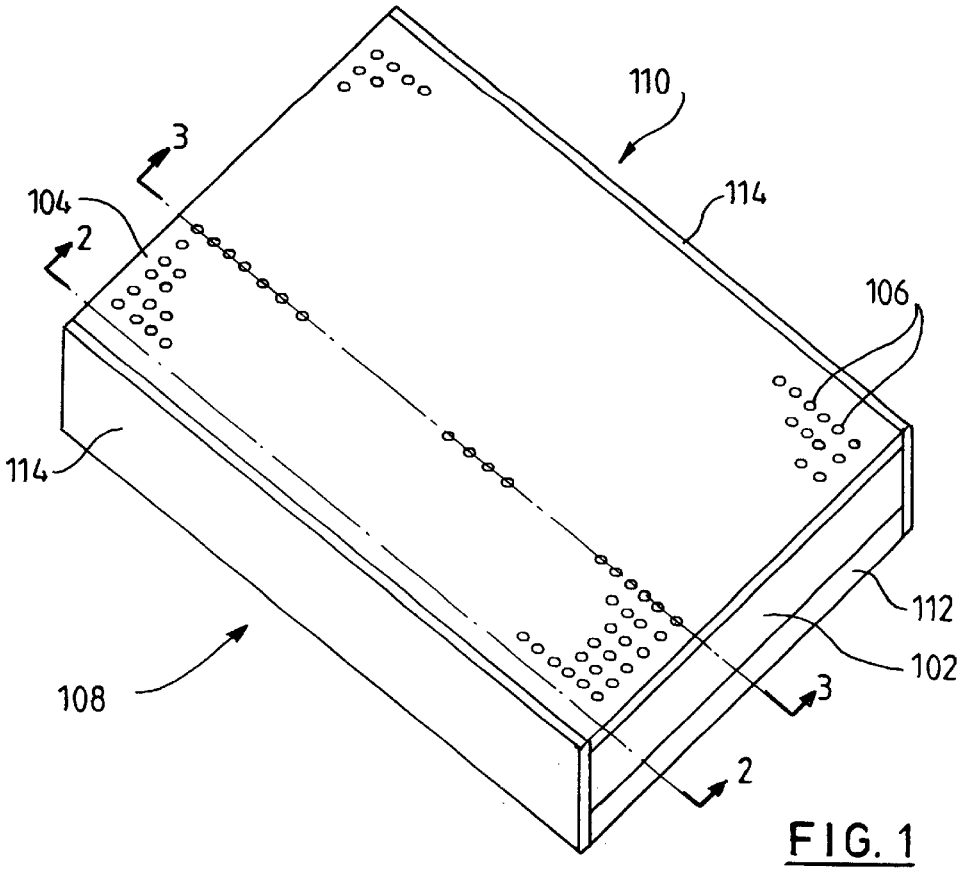
FIG. 1 is an isometric view of a first embodiment of a magnetic channel cathode according to the present invention, in which a line filament cathode (or multiple small emitters) are used.

FIG. 1 illustrates an embodiment of a magnetic channel cathode of the present invention. The dimensions given are suitable for use in a 0.3 mm pixel pitch high resolution display and are given for exemplary purposes only. For other pitches of display, different dimensions would be used. A flat permanent magnet 102, 0.6 mm thick and the same area as the display, has grooves in the surface. Each groove is 0.3 mm pitch with walls 0.075 mm thick and groove depth 0.225 mm. The grooves run vertically assuming that a conventional row selection display is used. Over the top of this is placed a second flat permanent magnet 104, of thickness 0.075 mm. This second magnet 104 has the effect of forming the open grooves in the first magnet 102 into closed channels. The second magnet 104 is ungrooved and has a matrix of 0.15 mm apertures 106 machined through it at the 0.3 mm pixel pitch. There is a 10 mm strip at the top and at the bottom of the second magnet 104 which is left unperforated. The end of the channels are closed with a conducting plate 114. The flat permanent magnet 102 is fixed to a stainless steel base plate 112.

The magnetic channel cathode structure is magnetised to form the north pole 108 at the top of the display and the south pole 110 at the bottom of the display. Methods of manufacturing and magnetising this structure based on existing processes will be described later.

Figure 2:
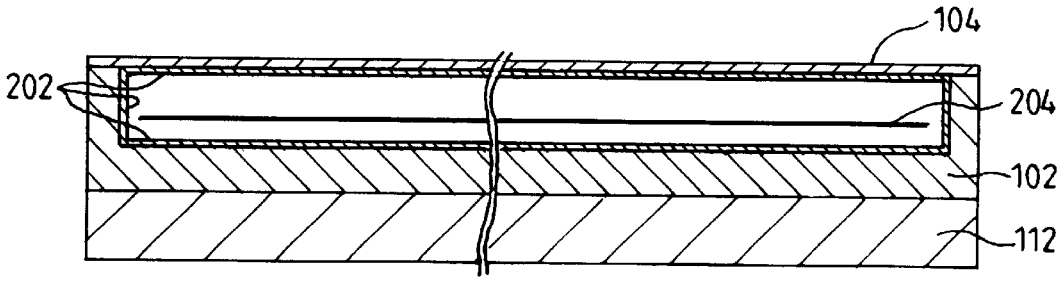
FIG. 2 is a cross-section view of the magnetic channel cathode of FIG. 1, the cross-section being taken at one end of the cathode, in the area of the unperforated portion of the top magnet plate 104.

FIG. 2 shows a cross-section view of the magnetic channel cathode of FIG. 1, the cross-section being taken at one end of the cathode, in the area of the unperforated portion of the top magnet plate 104. At one end of each channel is placed a suitable electron source. The other end of the electron channel is empty and has no electron source. A line filament cathode 204 is shown in FIG. 2 as an electron source. Alternative cathodes can be used, and some suitable choices will be described later. On the inside of the closed channels formed by the magnets 102 and 104, the surfaces have a thin conductive coating 202, which is connected to the conducting plate 114 at each end of the channel.

Figure 3:
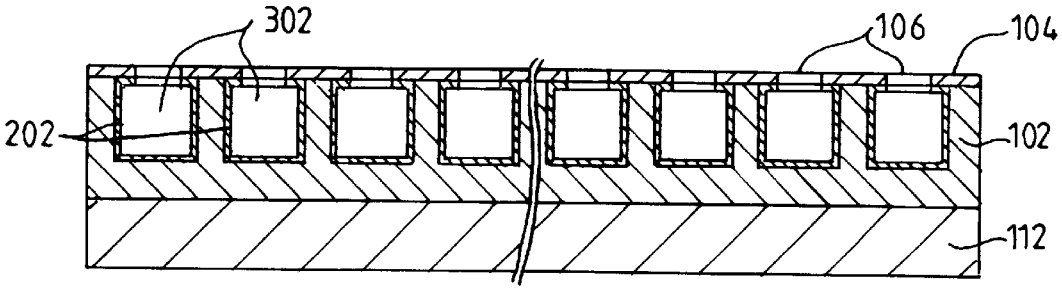
FIG. 3 is a cross-section view of the magnetic channel cathode of FIG. 1, the cross-section being taken at the central portion of the cathode.

FIG. 3 shows a cross-section of the magnetic channel cathode of FIG. 1, the cross-section being taken at the central portion of the cathode. Channels 302 can be seen in this cross-section view, as can the thin conductive coating 202. There are apertures 106 in top magnet plate 104 corresponding to each of the channels 302. These holes are repeated along each of the channels 302 at the 0.3 mm pixel pitch.

For the purposes of the description of the basic operation of the device, it will be assumed that a line filament cathode 204 is used. This can be modelled as a point thermionic cathode in each channel 302. Each point thermionic cathode can be regarded as a space charge limited electron source, and for the purposes of the description of the basic operation of the device, −1V will be placed on the cathode 204 and 0 V on the magnet channel conducting surfaces 202.

Electron Beam Channelling

With −1 V on the cathode and 0 V on the conductive surfaces 202 of the channels 302 in the magnet, a basic thermionic diode is formed, and electrons will be drawn into the magnet channel 302 from the cathode 204. However, on entering the channel 302 the electrons encounter a magnetic field whose flux lines run parallel to the walls of the channels 302 down the length of the channel 302. Electrons spiral around such flux lines. Since the entire inner surface of each channel 302 is uniformly at 0 V, this is an electrostatic field free volume, and there is no acceleration or retardation of the electrons, that is, they continue to spiral until they are absorbed by the end wall 114. The diameter and pitch of the spiral depends on the strength of the magnetic field and the electron velocity. Thus down the length of each channel 302 is created a source of electrons of low eV (1 eV nominal in this case) and uniform density.

The above description would be entirely correct if each channel 302 were magnetically totally enclosed, with equal wall thickness all round, However, the presence of apertures 106 perforating the front surface of the magnet channels 302 modifies the electron behaviour significantly.

Figure 4:
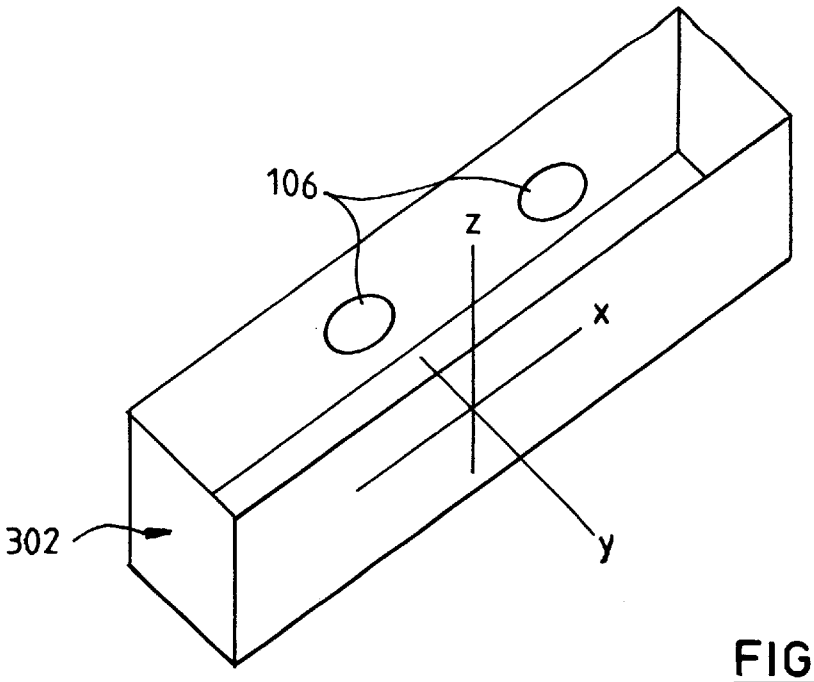
FIG. 4 is an isometric view of one of the closed channels in the magnetic channel cathode of FIG. 1, with the flux directions defined as they will be referred to in the subsequent figures.

FIG. 4 shows one of the closed channels in the magnet with the flux directions defined as they will be referred to in the subsequent figures.

Figure 5:
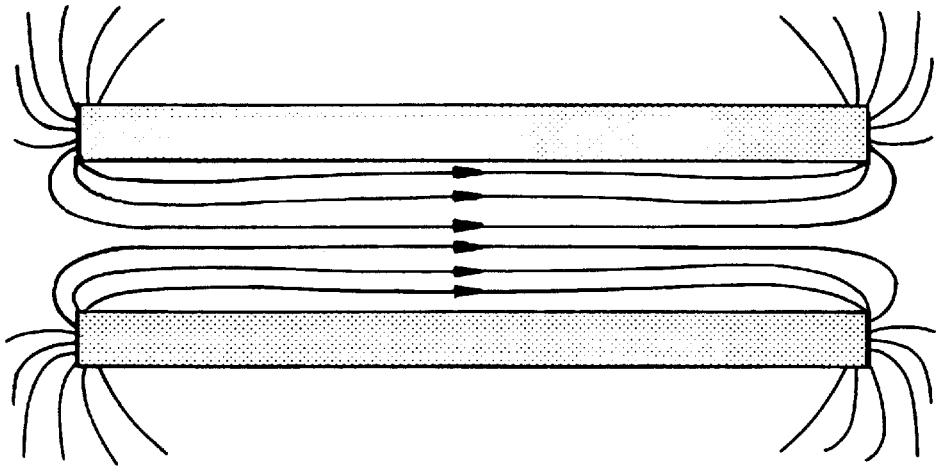
FIG. 5 is a cross-section view of the unperforated portion of the channels in the magnetic channel cathode of FIG. 1, showing X and Z directed flux lines.

FIG. 5 shows X and Z directed flux lines through a portion of a closed channel.

Figure 6:
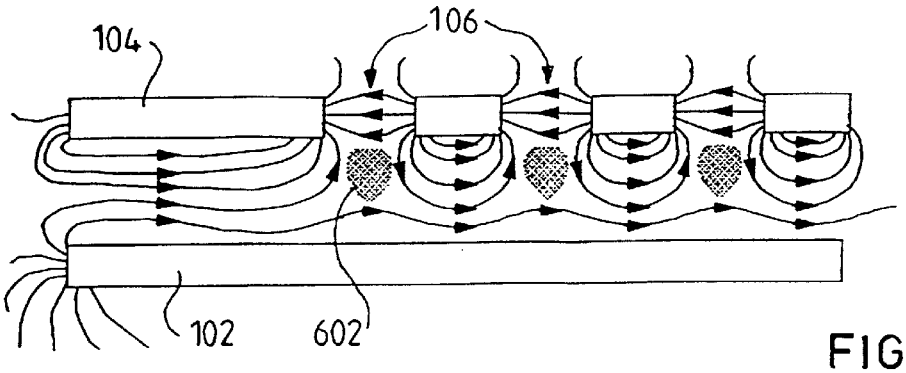
FIG. 6 is a cross-section view of the perforated portion of one of the closed channels in the magnetic channel cathode of FIG. 1, showing X and Z directed flux lines.

FIG. 6 shows X and Z directed flux lines through a portion of a perforated channel. Compared to the flux lines shown in FIG. 5 for the closed channel, the open apertures 106 cause flux reversals and a null field region 602 under each aperture 106. The closer an electron is to the perforated surface 104 the more disturbed its path becomes and some electrons are eventually lost by absorption to the walls. Electrons furthest from the perforated surface 104 suffer the least disturbance. Finite element simulation reveals a more subtle effect in that the presence of the apertures 106 gives rise to a small net field in the Z direction, and because electrons move at right angles to a magnetic field this produces a gradual movement in the Y direction.

Figure 7:
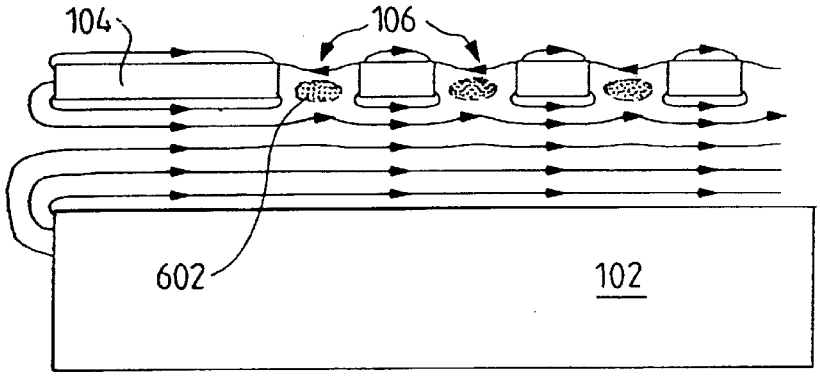
FIG. 7 is a cross-section view of the perforated channel of FIG. 6, modified so that the magnet plane 102 furthest from the apertures 106 is thicker.

FIG. 7 shows the perforated channel of FIG. 6, modified so that the magnet plane 102 furthest from the apertures 106 is thicker. This has two advantages, firstly the flux density is increased within the channel (so increasing the isolation from external fields), and secondly the null field points 602 and non linearities are moved into the perforated apertures. The field within the channel now becomes essentially linear, with no field reversals. The Z directed field and hence the sideways drift of electrons is much reduced.

Figure 8:
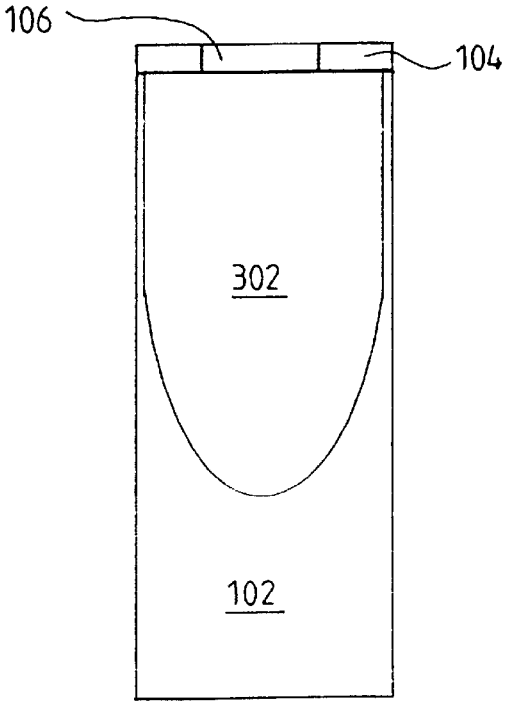
FIG. 8 is a cross-section view of a further variation of the perforated channel of FIG. 6, in which a curved and deeper channel cross-section is used.

FIG. 8 shows a cross-section view of a further variation of the perforated channel, in which a curved and deeper channel cross-section is used. This has the advantage that the volume of magnetic material towards the non perforated plate is increased. By adjustment of the material thickness, it is possible to obtain null regions which are entirely above the apertures, so presenting a very low disturbing field to extracted electrons.

Electron Collection

At the entrance to the channel the electrons are automatically collimated by the magnetic field along the length of each channel 302. The magnetic field should be linear over a sufficient length of the channel 302 to allow collimation to become established. Typically, a linear (i.e. non perforated) region of about ten or more times the pixel pitch is sufficient. This dimension may vary with other parameters, but needs to be chosen such that collimation is established.

Electron Extraction

To extract electrons from the channel 302 it is necessary to place an electric field over an aperture 106. Typically, +5 V applied at the surface of an aperture 106 extracts all electrons. With +1 V applied at the aperture 106, only a proportion of the electrons are extracted. This simple low voltage extraction method modulates the beam in the required manner. It is the high energy electrons that are collected first (that is those electrons with the highest eV) and therefore this extraction method can also be used as an eV filter, selecting only those electrons with the desired energy.

The extracted electrons can be used by a number of different display types including a Magnetic Matrix Display, such as that disclosed in UK Patent Application 2304981. This patent application discloses a magnetic matrix display having a cathode for emitting electrons, a permanent magnet with a two dimensional array of channels extending between opposite poles of the magnet, the direction of magnetisation being from the surface facing the cathode to the opposing surface. The magnet generates, in each channel, a magnetic field for forming electrons from the cathode means into an electron beam. The display also has a screen for receiving an electron beam from each channel. The screen has a phosphor coating facing the side of the magnet remote from the cathode, the phosphor coating comprising a plurality of stripes per column, each stripe corresponding to a different channel.

Figure 9:
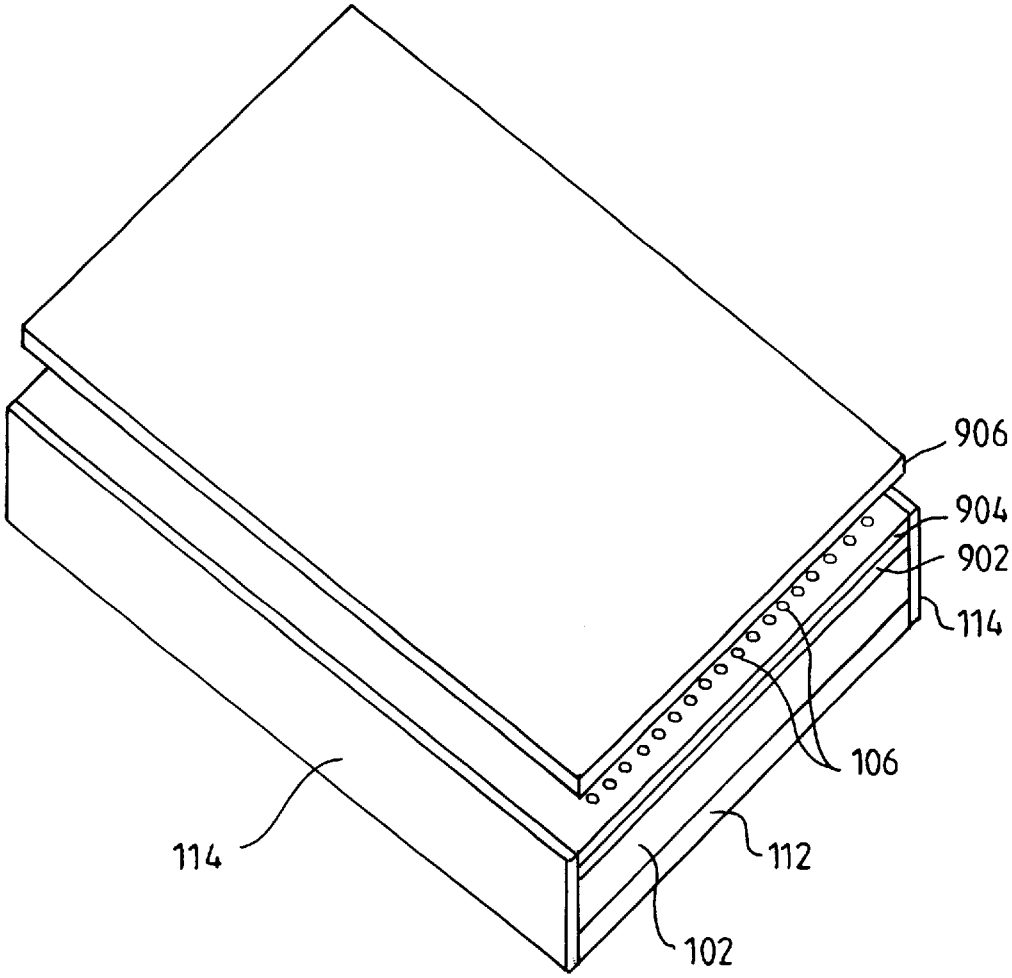
FIG. 9 is an isometric view of a variation of the magnetic channel cathode of FIG. 1, in which two perforated ceramic plates are placed over the cathode.

FIG. 9 shows an alternative to the Magnetic Matrix Display, in which two perforated ceramic plates 902, 904, each having a conducting surface, are placed over the cathode. The conducting surfaces may be on either face of the ceramic plates 902, 904, so long as they are separated. These plates 902, 904 form a simple electrostatic focus lens for each aperture 106. A screen 906 coated with FED type low voltage phosphors is placed close to the plates 902, 904. The conductive surface of the top ceramic plate 904 can also be etched into a stripe pattern, to incorporate colour selection by the micro beam steering method used in a Magnetic Matrix Display and disclosed in UK Patent Application 2304981. If FED low voltage phosphors working at less than 1 kV are used, then two ceramic plates 902, 904, each 0.4 mm thick with powder blasted tapered holes can be used to space the phosphor plate 906 from the cathode (in a similar manner to the Philips Zeus construction), leading to a self supporting display less than 5 mm thick.

Electron Sources

There are a number of different types of electron sources which can be used in a Magnetic Channel Cathode. Use of line filament thermionic cathodes 204 in flat panel displays by Matsushita is disclosed in "A 14-in. Color Flat-Panel Display using filament cathodes", Yamamoto et al, SID 94 Digest, pp381–384, and by Philips in "Triodes for Zeus displays", Montie et al, Philips J. Res. 50 (1996), pp281–293. Micromachined thermionic cathodes (about 10 $\mu$m ×20 $\mu$m ×2 $\mu$m oxide coated heated microcathodes) were first demonstrated in the 1970's, and more recently Utah University has demonstrated a prototype display based on this concept and disclosed in L Sadwick et al. "Microminiature thermionic vacuum flat panel display prototype", Proc. IEEE 1996, IEEE International Conference on Plasma Science. p245. Silicon semiconductor sources have been used by Philips and are disclosed in H Ligthart, G Van Gorkom, A Hoeberechts, "A flat CRT based on an array of p-n emitters", Optoelectronics - Devices and Technologies Vol. 7 No. 2 Dec. 1992 pp 163–178. Other cathode types such as FED or MIM can also be used. Since all these are well known and understood the electron source will not be further described here except to point out that it is easily possible to include control grids between the source and the channel if desired, for example, for beam current control or further focusing.

Manufacturing Methods

The two magnetic plates necessary for the manufacture of a specific embodiment of the invention, that is a 16" (406.4 mm) viewable diagonal display with pixels on 0.3 mm centres will now be described.

First plate (102)

A 0.6 mm thick magnet 265 ×318 mm is needed, which can be ferrite, glass bonded ferrite, metal or glass bonded metal magnet material. This magnet 102 must be grooved down the short dimension with 0.225 mm wide grooves on 0.3 mm centres, a total of 1024 grooves. The depth of each groove should be 0.225 mm. This produces grooves having a cross-section of 0.225×0.225 mm. The grooves are a substantially constant cross-section along their length. The material used for the first magnetic plate is conventional and the flat ungrooved plate may be made by standard mass production zero x,y shrinkage techniques from wet slurry pressing or greensheet doctor blading followed by sintering. Alternatively, a grooved doctor blade may be used to produce the plate directly followed by a zero shrinkage sintering process. If a plain sintered plate is produced then the grooves may be produced by powder blasting or grinding, such as is described in "Glass and glass machining in Zeus panels", Ligthart et al, Philips J. Res. 50 (1996), pp. 475–499, both of which are known processes. Photoetching of the magnet plate may also be used and is described in U.S. Pat. No. 5,294,520. The channel aspect ratio of 1:1 makes any such processing simple to implement, and higher aspect ratios could be produced and used if required. A non magnetic stainless steel plate 112 can advantageously be attached to the ungrooved surface of the plate 102 to give increased tensile strength.

Second plate (104)

A 0.075 mm thick magnet 265×318 mm, is required, which is also ferrite, glass bonded ferrite, metal or glass bonded metal magnet material. The second plate 104 must be perforated with 0.15 mm diameter apertures all over at the pixel pitch of 0.3 mm. There is a 10 mm strip at the top and at the bottom of the second plate 104 which is left unperforated. The holes may be produced by punching at the greensheet stage followed by sintering in a zero x,y shrinkage sintering process, or by powder blasting a fully sintered blank. These are known processes. A photoetching process could also be used. The aperture aspect ratio of 2:1 diameter to depth is easily produced by any of these processes. The perforated plate is extremely fragile but existing production processes developed for handling large thin glass sheets in the LCD industry (usually based on air cushion beds) can be used.

Coating

Each plate 102, 104 must be coated on one surface with a thin conductive film. Existing aluminium sputtering processes are suitable for this.

Assembly

The two plates 102, 104 are now brought together, aligned (either visually or via tooling holes) and bonded together with glass frit. Alternatively, the plates 102, 104 may be bonded together using ultrasonic welding between the aluminium coating at specific points. Once the plates are bonded together the resulting laminate is no longer fragile and the structure is strong, especially if a stainless steel backing 112 is used for the first sheet 102.

Electron Source

In a preferred embodiment, a filament thermionic cathode is used. In a variation of the preferred embodiment an indirectly heated filament thermionic cathode may be used, as is disclosed in Japanese Patent Application JP 4-245159 (A Futaba, indirectly heated long filament wire).

In a further variation of the preferred embodiment, micromachined cathodes, which have been demonstrated in a display application in L Sadwick et al. "Microminiature thermionic vacuum flat panel display prototype", Proc. IEEE 1996, IEEE International Conference on Plasma Science. p245. are used. These have the advantage of both very low power and a low heat load. A typical manufacturing process starts with a glass strip 318 mm long, 0.5 mm wide and 1 mm thick. Then what will become support posts are etched into the surface followed by the deposition of a high etch rate glass coating, which is left clear of the support posts. A thin tungsten layer is deposited by sputtering or CVD, and patterned via resist, photoexposure and etching into small tungsten strips 10 $\mu$m wide ×20 $\mu$m long ×2 $\mu$m thick. An etching process removes the glass under the strips, leaving a freely suspended set of what will become microemitters. Such a process is described in F Hochberg, H Seitz, A Brown, "A thin film integrated incandescent display", IEEE Transactions on Electron Devices, Vol. ED-20, No. 11, November 1973. pp 1002–1050, and more recently by Utah University in L Sadwick et al., mentioned above. The microemitters are conventionally plated with a triple carbonate coating, which, after activation in vacuum, will be converted to a standard triple oxide cathode layer. The whole strip is then bonded to one end of the channels.

Magnetisation

The structure described above is made in an unmagnetised state, to prevent contamination by magnetic attraction of fine particles floating in the atmosphere. After assembly it must be magnetised with the North–South orientation shown in FIG. 1. This has the problem that the structure must be placed in a magnetic field sufficiently strong to orient the magnet domains, and over a distance of over 250 mm. To avoid an excessively large magnetising magnet being necessary, the structure is heated to a temperature close to the Curie point of the magnetic material, when only a very weak field is needed to orient the domains. When cooled to a little below this temperature the domains are locked in place and the assembly can be removed to complete its cooling.

External Magnetic Fields

External fields emanating from the structure are in the same direction as the channels and are therefore vertical if the channels are vertical (which would the usual situation). Fields in this direction tend to shift the picture horizontally. If the fields are strong enough to cause a visible effect on the screen, then the shift can be compensated by an offset on the micro beam steering deflection anodes. Alternatively, a shielding plate of moderate permeability (say mu=10 to 100) placed above the cathode shunts most of the field away without causing any appreciable effect on the magnetic field in the channels. The top plate 104 of the magnet could be magnetic stainless steel to achieve this.

Emission Control

A problem in using multiple emission sources, or long filaments, is that the electron emission may not be uniform.

This has been recognised in other displays of this type, and it has become usual to incorporate stabilisation by monitoring and controlling the emission current. "Triodes for Zeus displays", Montie et al, Philips J. Res. 50 (1996), pp281–293. discloses applied channel emission control in Philips' Zeus display. The Magnetic Channel Cathode allows for emission control by virtue of the fact that the current from each electron source is all absorbed by the channel walls during the display blanking periods. By arranging the conductive coating of each channel to be separate, connection can be made (preferably via a multiplexer) to a sampling circuit during, for example, horizontal or vertical blanking, and the emission current value digitised and stored. Since current changes in the sources are always slow it is only necessary to sample the current intermittently. The stored value can then be used to control emission by altering the voltage on the cathode (in the case of a thermionic source), the device current (in the case of a semiconductor source) or the voltage on a control grid.

What is claimed is:

1. An electron source comprising cathode means, a permanent magnet having a plurality of channels, extending between opposite poles of the magnet, parallel to a first surface of the magnet, the cathode means being located at a first pole of the magnet, the internal surfaces of each of the channels being conductive, each channel having a plurality of perforations located on the first surface of the magnet, the surface extending between opposite poles of the magnet, wherein a potential applied between the cathode means and the conductive internal surfaces of the channels causes electrons to be received into the channels and wherein each perforation forms electrons received from the cathode means into an electron beam for guidance towards a target.

2. An electron source as claimed in claim 1, wherein the cathode means comprises a line filament cathode.

3. An electron source as claimed in claim 2, wherein the line filament cathode is indirectly heated.

4. An electron source as claimed in claim 1, wherein the cathode means comprises a micromachined cathode.

5. An electron source as claimed in claim 1, wherein the magnet comprises ferrite, metal, sintered metal powder or metal powder embedded in a glass matrix.

6. An electron source as claimed in claim 1, wherein the magnet comprises a first magnetic plate having grooves, extending between opposite poles of the magnet, along a first surface of the first magnetic plate, and a second magnetic plate having a plurality of perforations, said second plate being located so as to close the grooves to form channels, the channels having perforations located on a surface extending between opposite poles of the magnet.

7. An electron source as claimed in claim 1, wherein the channels are arranged at a pitch corresponding to the pixel pitch of a display incorporating the electron source.

8. An electron source as claimed in claim 1, wherein each channel has a constant cross-section along its length.

9. An electron source as claimed in claim 1, wherein the magnet plane furthest from the perforations is at least twice as thick as the channel depth.

10. An electron source as claimed in claim 9, wherein each channel has a depth greater than the width of the channel and wherein the portion of the channel furthest from the perforations is curved in cross-section.

11. An electron source as claimed in claim 1 wherein each channel is quadrilateral in cross-section.

12. An electron source as claimed in claim 11 wherein each channel is square in cross-section.

13. An electron source as claimed in claim 1, wherein the perforations are disposed in the magnet in a two dimensional array of rows and columns.

14. An electron source as claimed in claim 1, wherein the perforations are arranged at a pitch corresponding to the pixel pitch of a display incorporating the electron source.

15. An electron source as claimed in claim 1, wherein each of said channels is unperforated for a distance from the cathode means of ten or more times the pitch of the perforations.

16. An electron source as claimed in claim 1, further comprising a non-magnetic stainless steel plate located on the surface of the magnet furthest from the perforations.

17. An electron source as claimed in claim 1, wherein the conducting surfaces associated with each of the channels are electrically separated.

18. An electron source as claimed in claim 1, wherein the end of each channel is closed by a conducting plate at the end of the magnet opposite the cathode means.

19. An electron source as claimed in claim 18, wherein each of the conducting surfaces is connected to the conducting plate.

20. A display device comprising: an electron source as claimed in claim 1; a screen for receiving electrons from the electron source, the screen having a phosphor coating facing the side of the magnet having perforations; two perforated ceramic plates, each having a conductive surface, so as to cause a flow of electrons from the cathode to the phosphor coating via the channels and perforations thereby to produce an image on the screen.

* * * * *